US005783103A

United States Patent [19]

Triplett, Jr.

[11] Patent Number: 5,783,103

[45] Date of Patent: Jul. 21, 1998

[54] SNAP TIE

[76] Inventor: Kenneth Triplett, Jr., 110 Westview Pl., Kalama, Wash. 98625

[21] Appl. No.: 799,373

[22] Filed: Feb. 14, 1997

[51] Int. Cl.[6] ..... E04G 17/07

[52] U.S. Cl. ..... 249/46; 249/190; 249/213; 249/216; 249/217

[58] Field of Search ..... 249/190, 191, 249/168, 46, 213, 214, 216, 217; 52/713, 712

[56] References Cited

U.S. PATENT DOCUMENTS

| | | | |
|---|---|---|---|
| 361,710 | 4/1887 | Miller . | |
| 991,755 | 5/1911 | Seibert | 249/190 |
| 1,214,829 | 2/1917 | Ross | 249/190 |
| 3,430,913 | 3/1969 | Johnson | 249/190 |
| 4,125,245 | 11/1978 | Seidl . | |
| 4,234,156 | 11/1980 | Wepf . | |
| 4,300,747 | 11/1981 | Brow . | |
| 4,527,768 | 7/1985 | Cohen | 249/190 |
| 4,678,156 | 7/1987 | Scalamandre et al. | 249/191 |
| 5,050,365 | 9/1991 | Edgar et al. . | |
| 5,351,456 | 10/1994 | Paine, Jr. . | |

FOREIGN PATENT DOCUMENTS

| | | | |
|---|---|---|---|
| 1292811 | 10/1972 | United Kingdom | 249/190 |

*Primary Examiner*—Patrick Ryan
*Assistant Examiner*—Joseph Leyson

[57] ABSTRACT

A new snap tie for the purpose of keeping snap ties in place during the forming process. The inventive device includes a snap tie which includes an elongated member with a conical shaped spacer fitted at about the center of the elongated member and a pair of wires embedded in the conical shaped spacer on opposite sides of the elongated member.

6 Claims, 3 Drawing Sheets

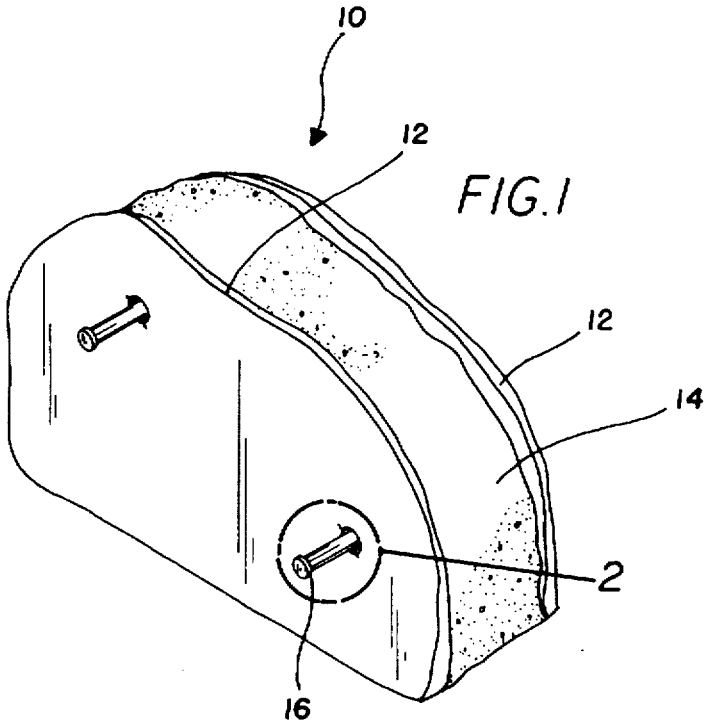
FIG.1
FIG.2
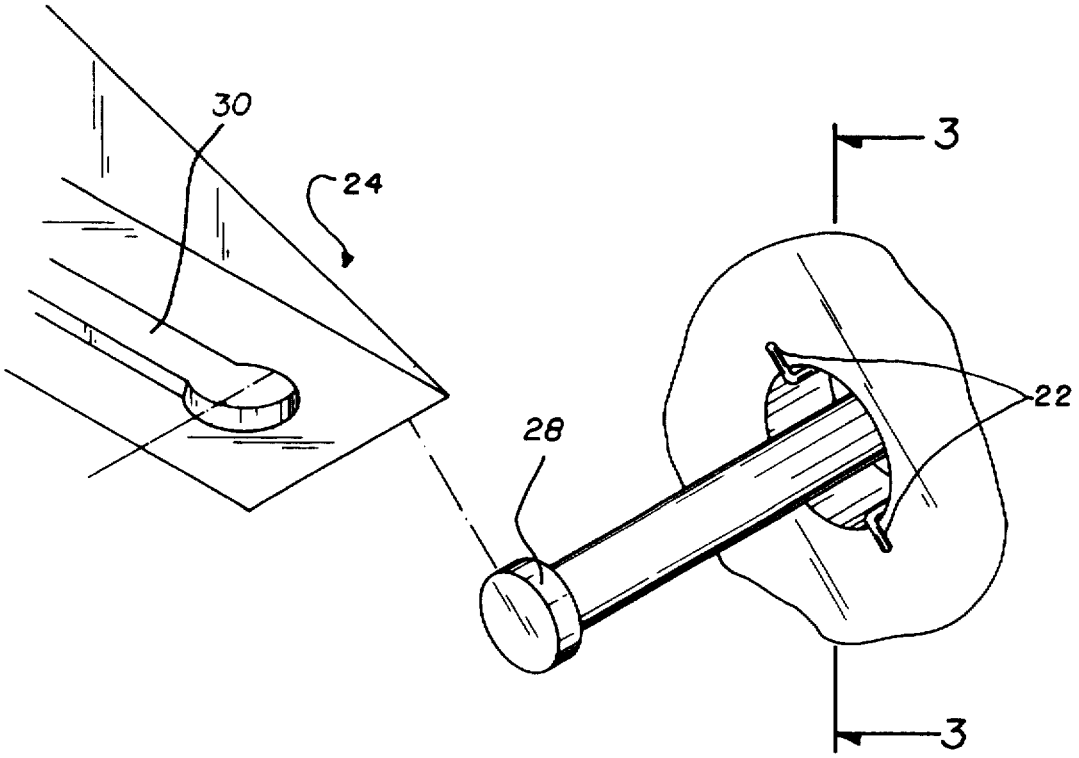

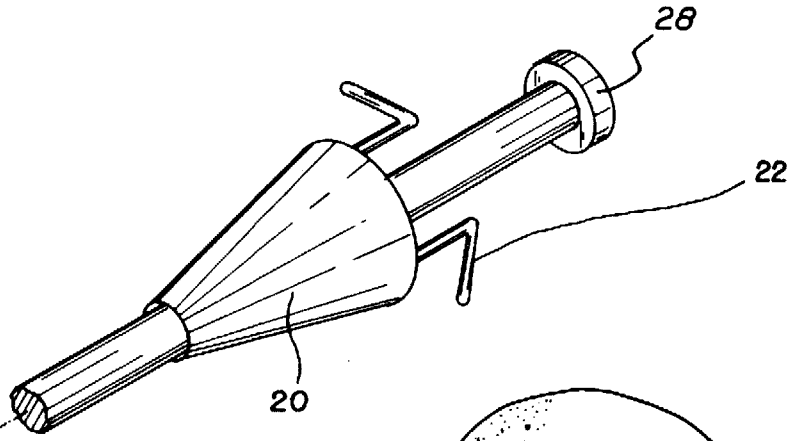
FIG.5
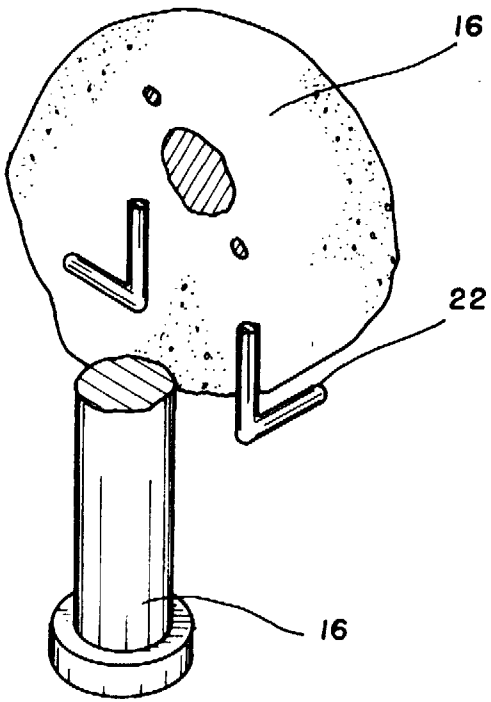
FIG.6
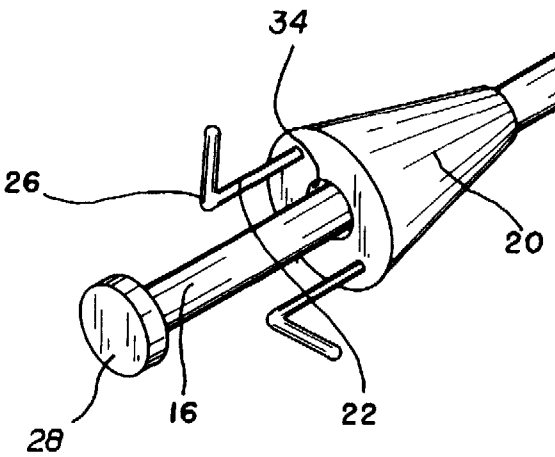

SNAP TIE

BACKGROUND OF THE INVENTION

1. Field of the Invention

The present invention relates to cement forming tools and more particularly pertains to a new snap tie for the purpose of keeping snap ties in place during the forming process.

2. Description of the Prior Art

The use of cement forming tools is known in the prior art. More specifically, cement forming tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art cement forming tools include U.S. Pat. No. 4,234,156; U.S. Pat. No. 4,300,747; U.S. Pat. No. 5,351,456; U.S. Pat. No. 5,050,365; U.S. Pat. No. 4,125,245 and U.S. Pat. No. 361,710.

While these devices fulfill their respective, particular objectives and requirements, the aforementioned patents do not disclose a new snap tie. The inventive device includes a snap tie which includes an elongated member with a conical shaped spacer fitted at about the center of the elongated member and a pair of wire means embedded in the conical shaped spacer on opposite sides of the elongated member.

In these respects, the snap tie according to the present invention substantially departs from the conventional concepts and designs of the prior art, and in so doing provides an apparatus primarily developed for the purpose of keeping snap ties in place during the forming process.

SUMMARY OF THE INVENTION

In view of the foregoing disadvantages inherent in the known types of cement forming tools now present in the prior art, the present invention provides a new snap tie construction wherein the same can be utilized for the purpose of keeping snap ties in place during the forming process.

The general purpose of the present invention, which will be described subsequently in greater detail, is to provide a new snap tie apparatus and method which has many of the advantages of the cement forming tools mentioned heretofore and many novel features that result in a new snap tie which is not anticipated, rendered obvious, suggested, or even implied by any of the prior art cement forming tools, either alone or in any combination thereof.

To attain this, the present invention generally comprises a snap tie which includes an elongated member with a conical shaped spacer fitted at about the center of the elongated member and a pair of wire means embedded in the conical shaped spacer on opposite sides of the elongated member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new snap tie apparatus and method which has many of the advantages of the cement forming tools mentioned heretofore and many novel features that result in a new snap tie which is not anticipated, rendered obvious, suggested, or even implied by any of the prior art cement forming tools, either alone or in any combination thereof.

It is another object of the present invention to provide a new snap tie which may be easily and efficiently manufactured and marketed.

It is a further object of the present invention to provide a new snap tie which is of a durable and reliable construction.

An even further object of the present invention is to provide a new snap tie which is susceptible of a low cost of manufacture with regard to both materials and labor, and which accordingly is then susceptible of low prices of sale to the consuming public, thereby making such snap tie economically available to the buying public.

Still yet another object of the present invention is to provide a new snap tie which provides in the apparatuses and methods of the prior art some of the advantages thereof, while simultaneously overcoming some of the disadvantages normally associated therewith.

Still another object of the present invention is to provide a new snap tie for the purpose of keeping snap ties in place during the forming process.

Yet another object of the present invention is to provide a new snap tie which includes a snap tie which includes an elongated member with a conical shaped spacer fitted at about the center of the elongated member and a pair of wire means embedded in the conical shaped spacer on opposite sides of the elongated member.

Still yet another object of the present invention is to provide a new snap tie that can be produced in a range of sizes which makes it adaptable for use in a variety of different constructions.

Even still another object of the present invention is to provide a new snap tie that allows a set of wire means to be inserted through holes in plywood panels to provide a more reliable stay in place prior to and during the installation of whalers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side perspective view of a new snap tie according to the present invention.

FIG. 2 is a side view of the snap tie in place with a wedge.

FIG. 5 is a side perspective view of a set of the present invention.

FIG. 6 is an exploded view of the present invention.

DESCRIPTION OF THE PREFERRED EMBODIMENT

Figure 3:
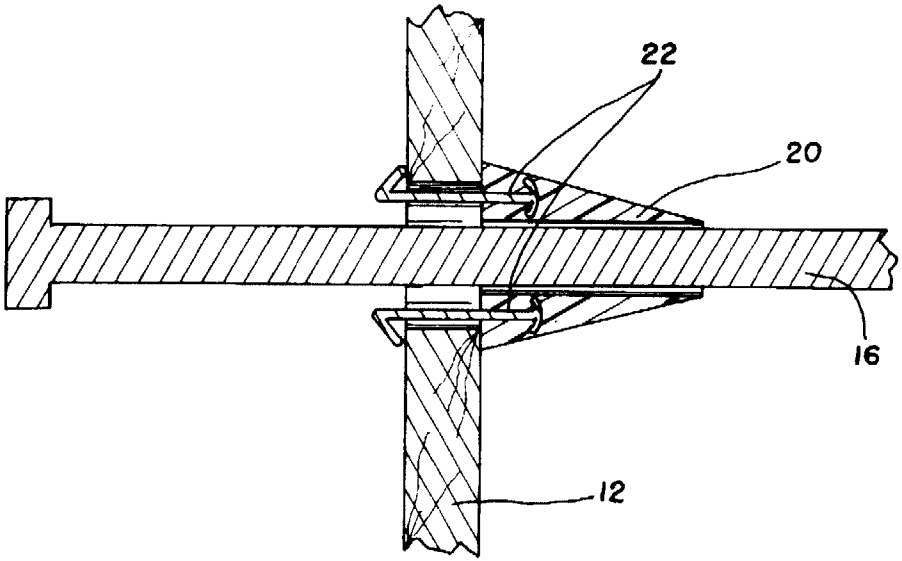
FIG. 3 is a cross sectional view taken along line 3—3 of FIG. 2.
Figure 4:
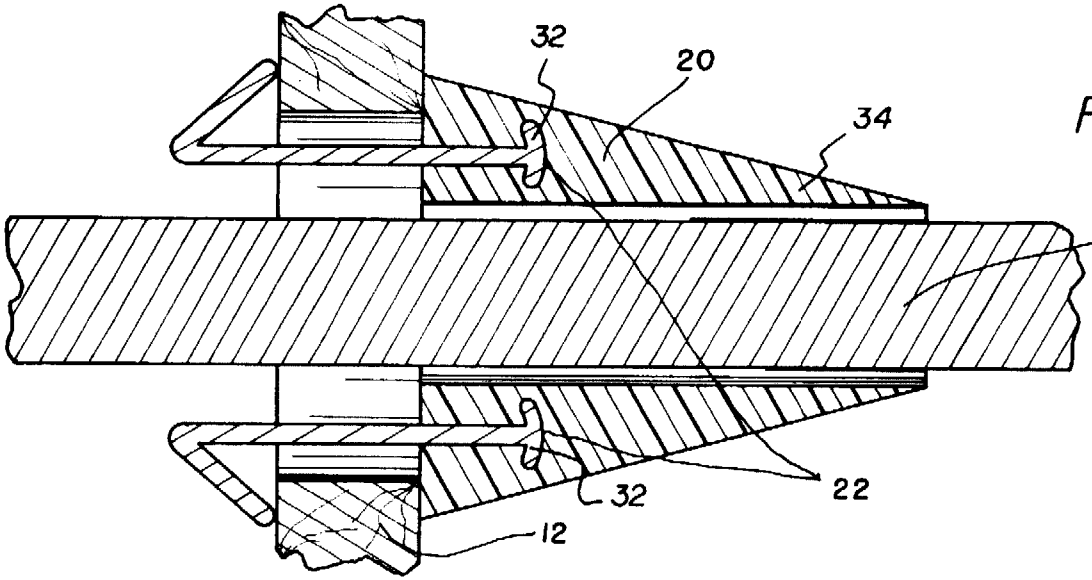
FIG. 4 is a more detailed cross sectional view taken along line 3—3 of FIG. 2.

With reference now to the drawings, and in particular to FIGS. 1 through 6 thereof, a new snap tie embodying the principles and concepts of the present invention and generally designated by the reference numeral 10 will be described.

More specifically, it will be noted that the snap tie 10 comprises a snap tie which includes an elongated member with a conical shaped spacer fitted at about the center of the elongated member and a pair of wire means embedded in the conical shaped spacer on opposite sides of the elongated member.

As best illustrated in FIGS. 1 through 6, it can be shown that the present invention teaches a novel nonobvious snap tie that meets a need in the industry.

The snap tie 10 of the present invention generally includes a snap tie which comprises an elongated member 16 which fits through a conical shaped spacer 20 so that the spacer 20 is positioned at about the center of the elongated member 16 and a pair of wire means 22 which are bent back at a first end 26 to form an angle. Preferably, the angle formed is less than 90° and about 45°. The wire means 22 forms a sealed relationship with the conical shaped spacer 20 on a side opposite the first end, wherein the pair of wires are positioned on opposite sides of the elongated member thus enabling the snap tie to remain in place. The snap tie 10 has at least one conical spacer 20 having a longitudinal passageway 34 therethrough. There is an elongated member 16 within the longitudinal passageway 34. A wedge locking cap 28 is on both ends of the elongated member 16. There is at least one wedge 24 and a locking slot 30 in the wedge 24. The locking cap 28 is releasably locked into the wedge locking slot 30. There are a pair of wire means 22 which are bent back at an angle end 26 to form an angle less than 90°. The pair of wires 22 have an arcuate end 32, within the conical shaped spacer 20, opposite the angle end 26. The pair of wires 22 are positioned on opposite sides of the elongated member 16 thus enabling the snap tie to remain in place. The arcuate end 32 of the pair of wires 22 are in a sealed relationship within the conical spacer 20.

The prior art Snap Tie has not been described in view of the teaching available about this device. U.S. Pat. No. 4,234,156 described a fairly similar type of snap tie to which the present invention is an improvement over. The elongated member 16 being made of a suitable strong and durable metal such as but not limited to steel.

The conical shaped spacer generally comprises plastic, however, any suitable material can be used to provide the desired effects. The wire means 22, measures about 1 inch in length with a diameter of about 1/16 inch and preferably comprises a metal. In another embodiment not shown in the figures is a pair of snap springs being fixedly connected to metal washer type snap ties. Preferably, the wire means 22 forms a sealed relationship with the conical spacer as a molded part.

In use, the present invention would include drilling of holes about 9/16 inch or 5/8 inch in diameter into sheets of plywood 12 which are about 5/8 inch or 3/4 inch thick. The end of the snap tie 10 is inserted through the hole where it remains in a perpendicular position to the plywood 12 until 2×4 whalers can be placed into position and tightened by the wedges 24. After all of the whalers have been put into position the process should be repeated on the other end of the snap ties. With this process completed, workers should be ready to pour the concrete wall 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A snap tie comprising:

at least one conical shaped spacer having a longitudinal passageway therethrough;

an elongated member positioned in the longitudinal passageway and having opposite ends;

a wedge locking cap on each end of the elongated member:

at least one wedge;

a locking slot in the wedge;

the locking cap releasably locked into the wedge locking slot;

a pair of wires each having first and second ends, each said wire being bent at said first end at an angle to form an angle of less than 90 degrees with respect to the elongated member;

the second ends of each of the wires having an arcuate character lodged in the conical shaped spacer, and wherein the pair of wires are positioned on opposite sides of the elongated member thus enabling the snap tie to remain in place.

2. The snap tie of claim 1, wherein the elongated member forms a metal bar.

3. The snap tie of claim 1, wherein the conical shaped spacer is plastic.

4. The snap tie of claim 1, wherein the pair of wires means measures about 1 inch in length with a diameter of about 1/16 inch.

5. The snap tie of claim 1, wherein the pair of wires are metal.

6. The snap tie of claim 1, wherein the arcuate ends of the pair of wires are in a sealed relationship within the conical spacer.

* * * * *